US006324709B1

(12) United States Patent
Ikeda et al.

(10) Patent No.: US 6,324,709 B1
(45) Date of Patent: Dec. 4, 2001

(54) MATTRESS APPARATUS AND BED APPARATUS

(75) Inventors: Shigeru Ikeda, Kunitachi; Noboru Sasaki, Akishima; Tatsuo Kamada, Fujieda, all of (JP)

(73) Assignee: France Bed Co., Ltd., Tokyo (JP)

( * ) Notice: Subject to any disclaimer, the term of this patent is extended or adjusted under 35 U.S.C. 154(b) by 0 days.

(21) Appl. No.: 09/518,935

(22) Filed: Mar. 3, 2000

Related U.S. Application Data

(63) Continuation of application No. PCT/JP99/02297, filed on Apr. 28, 1999.

(30) Foreign Application Priority Data

Jul. 31, 1998 (JP) ..... 10-217345

(51) Int. Cl.[7] ..... A61G 7/05

(52) U.S. Cl. ..... 5/185; 5/612; 5/613; 5/81.1 R; 5/722

(58) Field of Search ..... 5/612, 613, 176.1, 5/185, 81.1 R, 722, 739, 740, 902, 424, 425

(56) References Cited

U.S. PATENT DOCUMENTS 4,669,136 * 6/1987 Waters et al. ..... 5/185
5,077,843 * 1/1992 Dale et al. ..... 5/185
5,179,744 * 1/1993 Foster et al. ..... 5/425
5,377,370 * 1/1995 Foster et al. ..... 5/185
5,732,423 * 3/1998 Weismiller et al. ..... 5/424

FOREIGN PATENT DOCUMENTS 6-86729 12/1994 (JP) .
10-192345 7/1998 (JP) .

* cited by examiner

*Primary Examiner*—Michael F. Trettel
(74) *Attorney, Agent, or Firm*—Frishauf, Holtz, Goodman, Langer & Chick, P.C.

(57) ABSTRACT

The present invention provides a bed apparatus allowing a worker to easily move a user's body at the time of consultation and nursing of the user lying on his back on a floor plate. The bed apparatus comprises a bed frame. A floor plate is provided on the bed frame. A second recess portion dented inwardly in the lateral direction of the bed frame is formed on at least one side part of both lateral side parts of the floor plate. A support member is provided on the second recess portion so as to be movable inwardly in the lateral direction of the floor plate. An auxiliary member which can be deformed by compression is provided at a part corresponding to the second recess portion.

15 Claims, 8 Drawing Sheets

MATTRESS APPARATUS AND BED APPARATUS

CROSS-REFERENCE TO RELATED APPLICATIONS

This is a continuation of application Ser. No. PCT/JP99/02297, filed Apr. 28, 1999.

This application is based upon and claims the benefit of priority from the prior Japanese Patent Application No. 10-217345, filed Jul. 31, 1998, the entire contents of which are incorporated herein by reference.

BACKGROUND OF THE INVENTION

The present invention relates to a bed apparatus suitable for long term patients and aged persons who are handicapped in moving their bodies without help, for a long time.

Bed apparatuses for hospitals are used when people such as aged persons, patients and the like that cannot freely move their bodies without help enter, for example, old people's homes, hospitals and the like. There are various types of such bed apparatuses, and a "getup-type" bed apparatus is known as one of them.

The "getup-type" bed apparatus comprises a conventional bed frame, and a floor plate divided into a plurality of floor portions provided on the bed frame. One of the plural floor portions is fixed to the frame, and the floor portion corresponding to the upper body of the user is driven to be moved up and down by a drive mechanism.

Therefore, the user who cannot lift his upper body without help can do so by moving up the floor portion by the drive mechanism, and this is convenient for eating, reading, and the like.

Incidentally, the user lying on the bed apparatus periodically receives various consultation and nursing treatments (i.e., such as for excretion). When the user is handicapped in moving his body without help at the time of such a consultation or nursing, a consultant or a nursing worker (hereinafter called a worker) must lift up a part of the user's body and make the user turn over his body.

When the worker makes performs tasks such as lifting up a part of the user's body and making the user turn over his body, the worker ideally would like to put his body as close as possible to the user.

If the worker performs such tasks while keeping his body remote from the user, for example, the worker can hardly concentrate his strength. Therefore, the worker cannot easily execute his tasks, a large burden is loaded on the worker's lower back, and the worker may suffer from lower-back pain.

For this reason, when the worker nurses the user, it is preferable that the worker puts his body as close as possible to the user to execute his tasks. However, the floor plate of the bed apparatus has a predetermined width. Thus, when the user lies on his back at a center portion or an end portion in the lateral direction of the bed plate, the worker must often execute his tasks while he is unable to put his body close to the user from the opposite end in the lateral direction of the bed plate. For this reason, the worker cannot easily execute his tasks and/or may suffer from lower-back pain.

BRIEF SUMMARY OF THE INVENTION

The object of the present invention is to provide a mattress apparatus and a bed apparatus which allow the worker to put his body substantially close to the user at the time of consulting and nursing the user.

A preferred embodiment of the present invention provides a mattress apparatus having a cushion body which is covered in a bag-like packaging body, wherein the cushion body comprises a main body portion, and an auxiliary member which is provided on at least one side part of both lateral sides of the main body portion and is pressed inwardly in the lateral direction of the main body portion so as to be elastically deformed by compression inwardly therein.

A preferred embodiment of the present invention also provides a bed apparatus having a bed frame, and also having a floor plate provided on the bed frame, the bed apparatus comprising: a second recess portion formed on at least one of both lateral side parts of the floor plate to be dented inwardly in the lateral direction of the bed frame; a support member arranged in the second recess portion so as to elastically movable inwardly in the lateral direction of the floor plate; and a mattress apparatus placed on the floor plate, in which a part corresponding to at least the second recess portion of the lateral side portion is deformable by compression inwardly in the lateral direction of the floor plate.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The embodiments of the present invention will be explained below with reference to the drawings.

(First Embodiment)

Figure 3A:
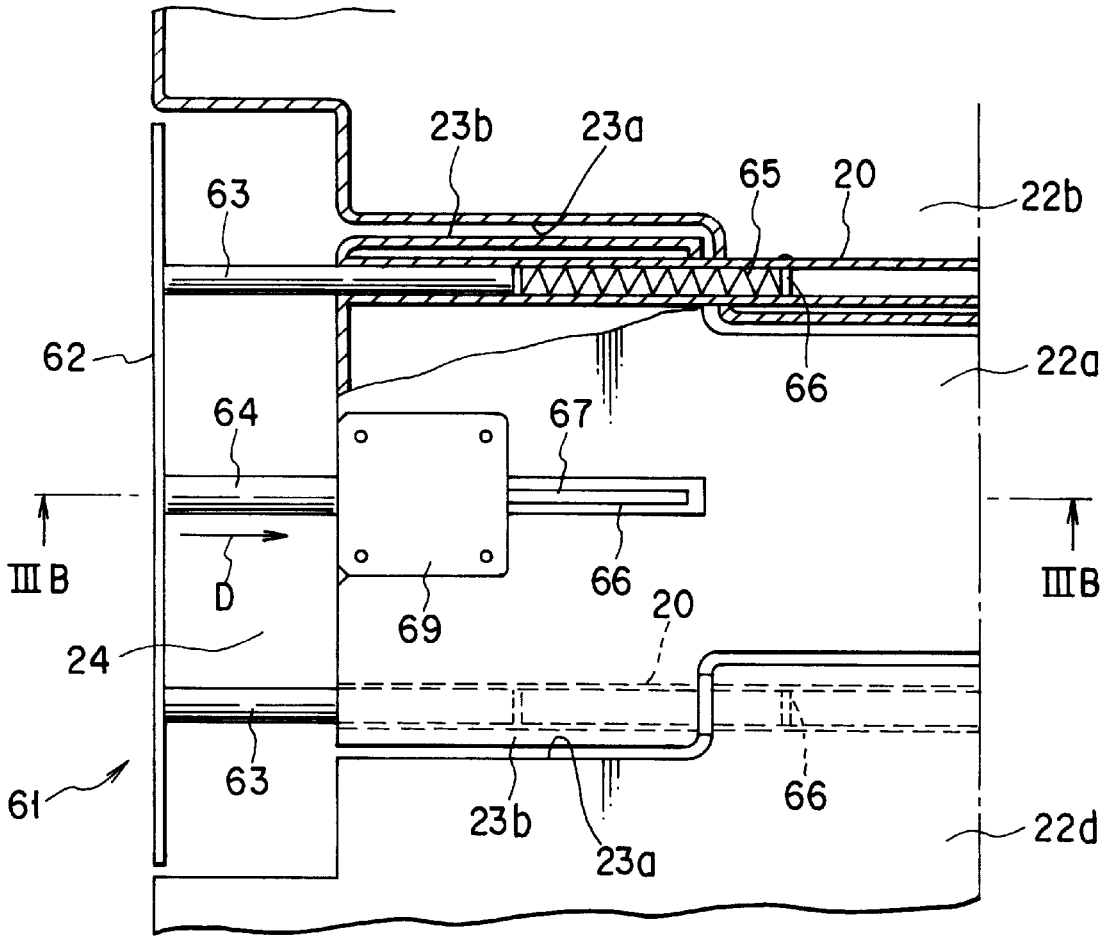
FIG. 3A is a partially sectional plan view showing a part where support means of a floor plate is provided, as seen from a lower surface side thereof.
Figure 3B:
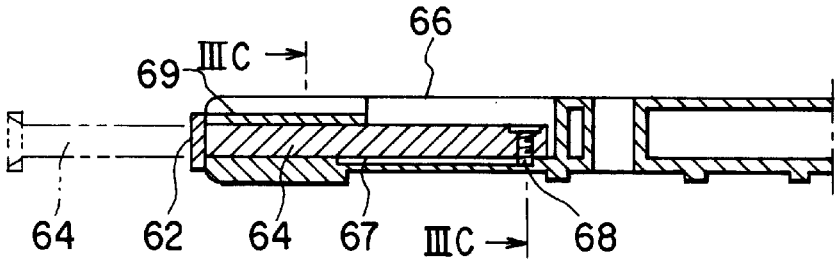
FIG. 3B is a sectional view as seen along a line IIIB—IIIB of FIG. 3A.
Figure 3C:
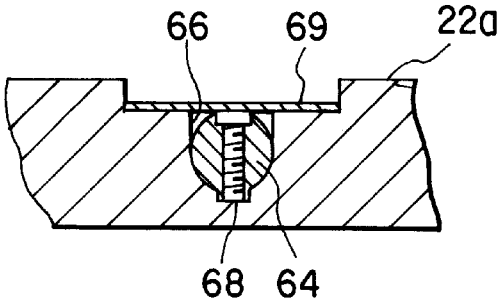
FIG. 3C is a sectional view as seen along a line IIIC—IIIC of FIG. 3B.
Figure 4:
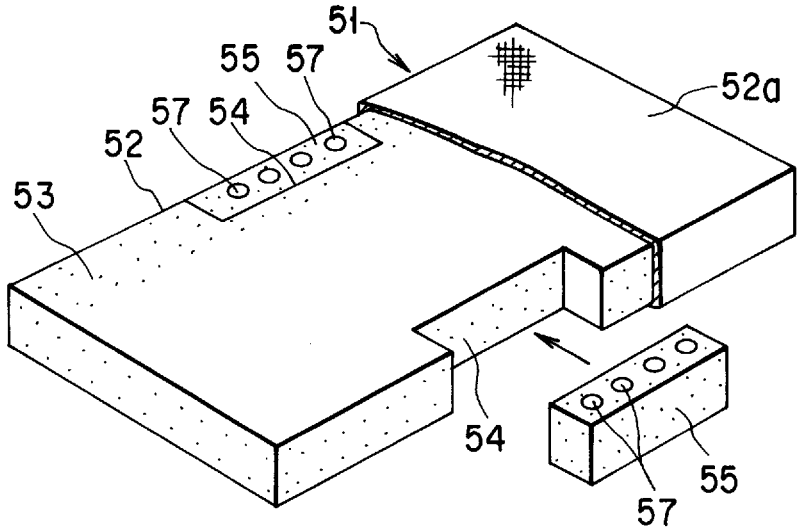
FIG. 4 is a perspective view showing a packaging body of the mattress apparatus partially removed.
Figure 5:
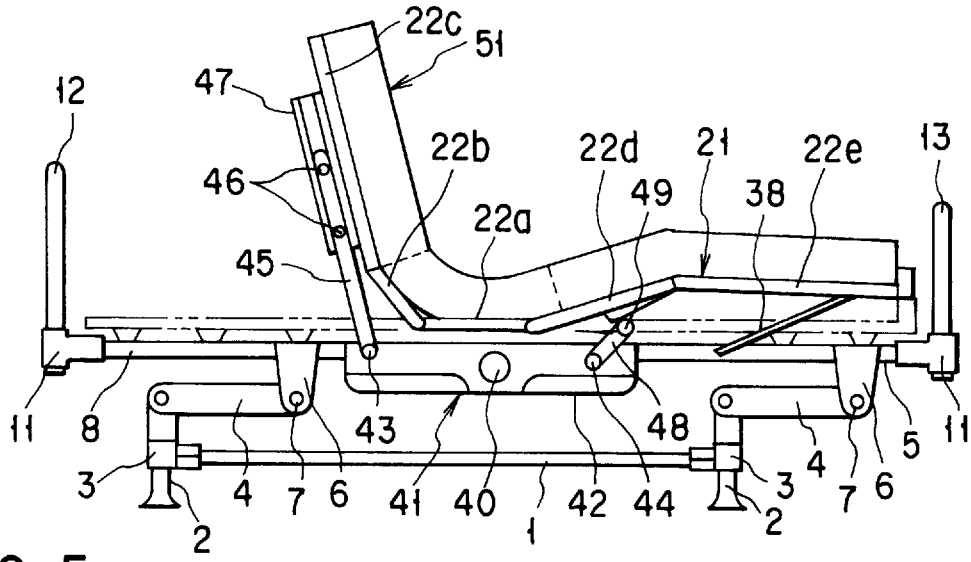
FIG. 5 is a side view showing a bed apparatus.
Figure 6:
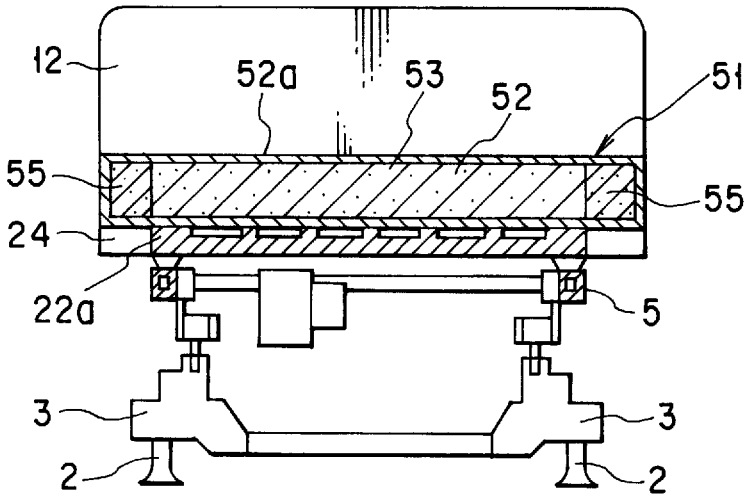
FIG. 6 is a horizontally sectional view showing a bed apparatus.

FIGS. 1 to 6 illustrate the first embodiment of the present invention, and a bed apparatus shown in FIGS. 5 and 6 comprises a base frame 1 having legs 2 at four corners of its lower surface. Attachment portions 3 are provided at four corners of the base frame 1, and an end of a vertical drive arm 4 is connected to each of the attachment portions 3 so as to be freely rotatable. The other end of each of the vertical drive arms 4 is connected to a bed frame 5.

That is, brackets 6 are vertically provided on both longitudinal ends at both ends of the bed frame 5. A lateral shaft 7 is provided at each pair of corresponding brackets 6 in the lateral direction of the bed frame 5 so as to be freely rotatable. The other end of the vertical drive arm 4 is fixed at each of the lateral shafts 7.

The pair of lateral shafts 7 are driven to be freely rotatable by a vertical drive mechanism (not shown). When the lateral shafts 7 are pivoted, the vertical drive arms 4 are driven to move up and down. Thus, the bed frame 5 connected to the other ends of the arms 4 is driven vertically.

The bed frame 5 is shaped in a rectangular frame in which ends of a pair of long rods 8 extending along the longitudinal direction of the bed frame 5 are connected to ends of a pair of short rods (not shown) extending along the lateral direction by connection members 11. A head board frame 12 is attached to a pair of connection members 11 positioned on one end side in the longitudinal direction, and a foot board frame 13 is attached to a pair of connection members 11 positioned on the other end side.

Figure 1:
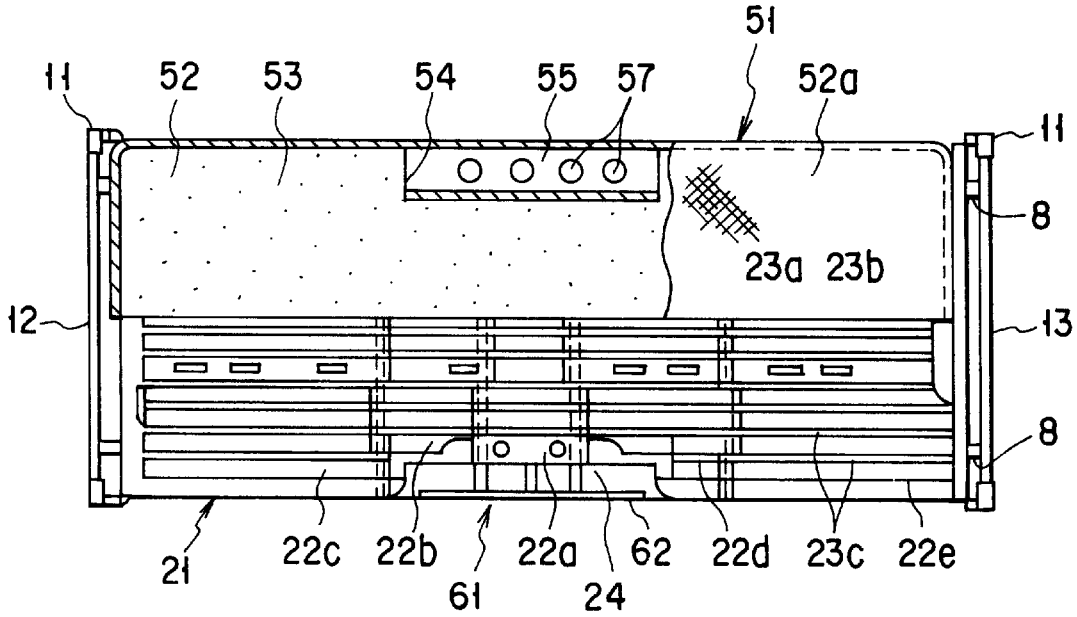
FIG. 1 is a plan view showing a bed apparatus, illustrating an entire structure of a first embodiment of the present invention.
Figure 2:
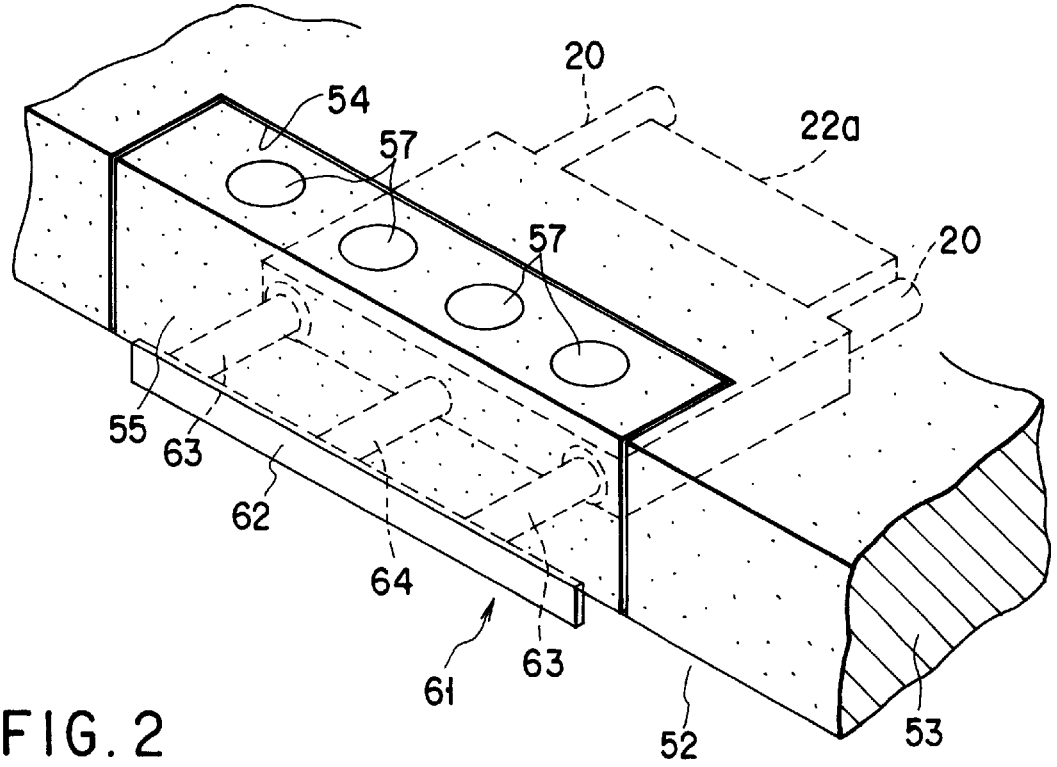
FIG. 2 is a perspective view showing essential portions thereof.

A floor plate 21 is provided on an upper surface of the bed frame 5. The floor plate 21 is constituted by five floor portions 22*a* to 22*e* divided along the longitudinal direction of the bed frame 5. A longitudinal center portion of the floor plate 21 is a fixed floor portion 22*a,* which is fixed on the bed frame 5. A waist floor portion 22*b* and a back floor portion 22*c* are connected in this order, to one side of the fixed floor portion 22*a* so as to be freely rotatable. A first leg floor portion 22*d* and a second leg floor portion 22*e* are connected in this order to the other side of the fixed floor portion 22*a* so as to be freely rotatable. The floor portions 22*a* to 22*e* are formed to be hollow by subjecting synthetic resin to the blow molding, and their end portions connected to be mutually rotatable are shaped in a recess and a protrusion so that a recess portion 23*a* and a protruding portion 23*b* are alternately formed as shown in FIGS. 1 and 3. That is, the recess portion 23*a* and the protruding portion 23*b* of the adjacent floor portions are engaged with one another, and this part is connected by a hollow connection shaft 20 shown in FIG. 3A so as to be freely rotatable. Further, protruding stripes 23*c* longitudinally extending as shown in FIG. 1 are formed laterally with a predetermined interval on the upper surface of the floor plate 21.

A pair of second recess portions 24 having a substantially rectangular plane shape are formed at both lateral sides of the floor plate 21. That is, the second recess portions 24 are formed such that the fixed floor portion 22*a* is shorter than the waist floor portion 22*b* and the first leg floor portion 22*d* positioned on both sides of the fixed floor portion 22*a* and that the parts of the waist floor portion 22*b* and the first leg floor portion 22*d* which are adjacent to the fixed floor portion 22*a* are removed in a square shape.

The interval of a pair of long rods 8 of the bed frame 5 is set to be almost equal to the length of the fixed floor portion 22*a* as shown in FIG. 1. Thus, the long rods 8 are not exposed to the second recess portion 24.

A back raising drive mechanism 41 is provided on the lower surface side of the bed frame 5 as shown in FIG. 5. The back raising drive mechanism 41 comprises a box 42 that has a drive source 40 on its one-side surface, and a first drive shaft 43 and a second drive shaft 44 whose axes extend along the lateral direction of the bed frame 5 are provided respectively on one end side and the other end side of the box 42.

An end of a first arm 45 is fixed at the first drive shaft 43 positioned on the head board frame 12 side. A pair of first rollers 46 are rotatably provided with a predetermined interval, on the other end part of the first arm 45. The rollers 46 are engaged with a bracket-sectioned rail 47 provided on the lower surface of the back floor portion 22*c,* so as to freely roll.

An end of a second arm 48 is connected to the second drive shaft 44. A second roller 49 is rotatably provided at the other end of the second arm 48. The second roller 49 abuts on the lower surface of the first leg floor portion 22*d.*

The first drive shaft 43 and the second drive shaft 44 are driven to rotate by the back raising drive mechanism 41. When the first drive shaft 43 is driven to rotate and the first arm 45 is pivoted in the raising direction, the waist floor portion 22*b* and the back floor portion 22*c* are raised. When the second drive shaft 44 is rotated and the second arm 48 is pivoted in the raising direction, the first leg floor portion 22*d* is driven in the raising direction and the second leg floor portion 22*e* interlocks with the first leg floor portion 22*d.*

A link 38 is provided between the second leg floor portion 22*e* and the bed frame 5 so as to be freely rotatable. Thus, the second leg floor portion 22*e* is held in a state interlocking with the first leg floor portion 22*d,* i.e. in a state forming a substantially bent shape with the first leg floor portion 22*d.*

A mattress apparatus 51 is placed on the floor plate 21. The mattress apparatus 51 comprises a cushion body 52 as shown in FIG. 4. The cushion body 52 is contained in a fabric packaging body 52*a* knitted in a bag shape.

The cushion body 52 is constituted by a main body portion 53 formed of an elastic material such as foamed urethane foam, sisal fiber, compression-molded cotton or the like in a substantially rectangular shape, and an auxiliary members 55 fixed by bonding at first recess portions 54 formed on longitudinal middle portions on both sides of the main body portion 53.

The auxiliary member 55 is formed of urethane foam or the like that is foamed to be much more elastic than the main body portion 53. The only side surface of the auxiliary member 55 is bonded to the inner side surface of the first recess portion 54 and both end surfaces thereof are not bonded.

Thus, the auxiliary member 55 can be easily deformed by compression inwardly in the lateral direction of the mattress apparatus 51.

A plurality of vertical holes 57 that are vertically opened are formed on the auxiliary member 55. Thus, the auxiliary member 55 can also be easily deformed by compression in the direction of the thickness. The vertical holes 57 may not be formed on the auxiliary member 55.

The auxiliary members 55 provided on both sides of the mattress apparatus 51 are formed symmetrically in the lateral and longitudinal directions of the mattress apparatus 51. Thus, even if the mattress apparatus 51 placed on the floor plate 21 is turned upside down or its longitudinal direction is changed for use, the positions of the auxiliary members 55 of the mattress apparatus 51 are not shifted from the second recess portions 24 of the floor plate 21.

Support members 61 are provided on the second recess portions 24 of the floor plate 21 so as to be elastically displaceable as support means. The support member 61 is constituted by a pair of guide rods 63 having one-side end connected to both longitudinal ends of a band-shaped connection plate 62, and a stopper rod 64 having one end connected to the center of the connection plate 62 as shown in FIG. 3A. A pair of guide rods 63 are inserted into the hollow connection shafts 20 so as to be freely slidable therein. That is, the end portions of the hollow connection shafts 20 serve as guide portions for slidably holding the support member 61.

A spring 65 is contained in the hollow connection shaft 20. The spring 65 is provided between the distal end of the guide rod 63 and a pin 66 provided on the hollow connection shaft 20 so as to elastically urge the support member 61 to protrude to the second recess portion 24. That is, the support member 61 can be pushed in the direction of an arrow D against the urging force of the spring 65, in a state protruding to the second recess portion 24 as indicated by a solid line in FIG. 3A.

The stopper rod 64 is inserted into a slide groove 66 formed to open to one end surface and a lower surface of the fixed floor portion 22*a,* so as to be freely slidable. A step portion 67 is formed to be dented on the slide groove 66 as shown in FIG. 3B, and a stopper 68 provided at the distal end of the stopper rod 64 is engaged with the step portion 67. The protruding position of the stopper rod 64 is thus restricted, and the support member 61 is thereby prevented from being pull out of the fixed floor portion 22*a*.

A pressing plate 69 is provided on the lower surface of the end portion of the fixed floor portion 22*a*. The pressing plate 69 blocks the slide groove 66 to prevent the stopper rod 64 from being detached from the slide groove 66.

According to the above-constituted bed apparatus, the second recess portions 24 that are dented in the lateral direction are formed at the longitudinal middle parts of both sides of the floor plate 21, and both lateral sides of the longitudinal center parts of the cushion body 52 of the mattress apparatus 51 are formed by the auxiliary members 55.

The auxiliary members 55 of the mattress apparatus 51 are elastic to be deformable by compression. The lower surface sides of the auxiliary members 55 are supported by the support members 61 protruding to the second recess portions 24 of the floor plate 21.

For this reason, the auxiliary members 55 supported by the support members 61 are not too deformed due to the load and, therefore, can be used effectively as a part of the general bed surface. That is, the effective area of the mattress apparatus 55 is not reduced by providing the auxiliary members 55. Moreover, the auxiliary members 55 are fixed to the first recess portions 54 of the main body portion 53 of the cushion body 52 and integrated therewith. For this reason, too, the sense of incongruity given to the user can be reduced and the comfort of sleeping is prevented from deteriorating.

On the other hand, when the worker consults or nurses the user such as an aged person, a patient or the like (not shown) lying on the mattress apparatus 51, he presses the connection plate 62 of the support member 61 protruding to the second recess portion 24 of the floor plate 21, and the auxiliary member 55 placed on the support member 61 of the mattress apparatus 51, by a part of his body, for example, the leg. Thus, the support member 61 slides in the inner direction against the urging force of the spring 65 and the auxiliary member 55 of the mattress apparatus 51 is deformed by compression. Therefore, the worker enters the second recess portion 24 of the floor plate 21 and can thereby approach the user lying on the mattress apparatus 51.

Thus, the worker can easily carry out tasks such as partially lifting up the user's body, letting the lying user turn over, and the like, with an attitude which does not cause excessive load on his waist. Further, the auxiliary member 55 of the mattress apparatus 51 can easily be deformed by compression by formation of the vertical holes 57 thereon and, for this reason, too, the worker can enter the second recess portion 24.

Further, when a user having weak legs is to get out of the mattress apparatus 51, he steps down from the second recess portion 24 of the floor plate 21. Thus, when the user tries to stand up, his legs are elastically held by the support member 61 and the auxiliary member 55 and, therefore, he can stand up in a more stable state than that in a case where his legs are not held.

That is, according to the above-constituted bed apparatus, the support member 61 protruding to the second recess portion 24 of the floor plate 22 is pushed elastically against the restoring force of the springs 65, and at the same time the auxiliary member 55 of the mattress apparatus 51 is deformed by compression, in the case of consulting and nursing the user. The worker can thereby approach the user by pressing into the second recess portion 24, and therefore, he can easily make consultation and nursing with a conformable attitude.

(Second Embodiment)

Figure 7:
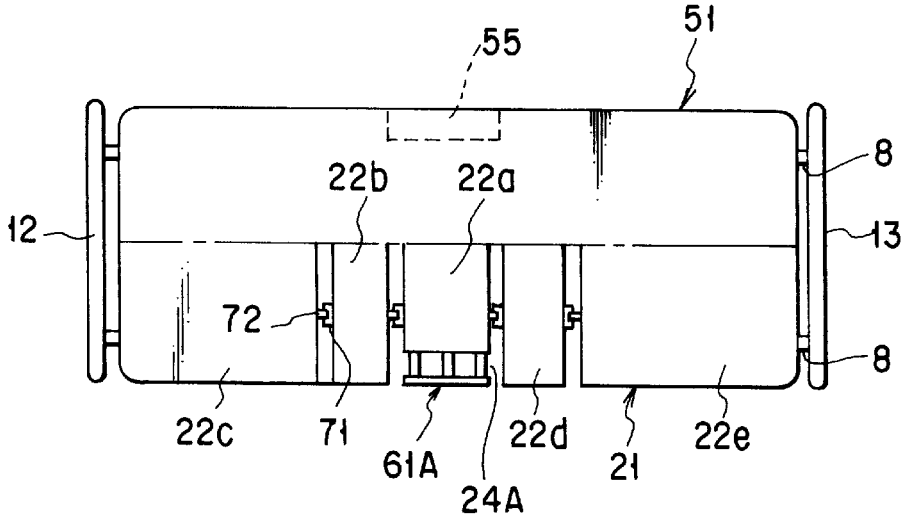
FIG. 7 is a plan view showing a bed apparatus according to a second embodiment of the present invention.
Figure 8:
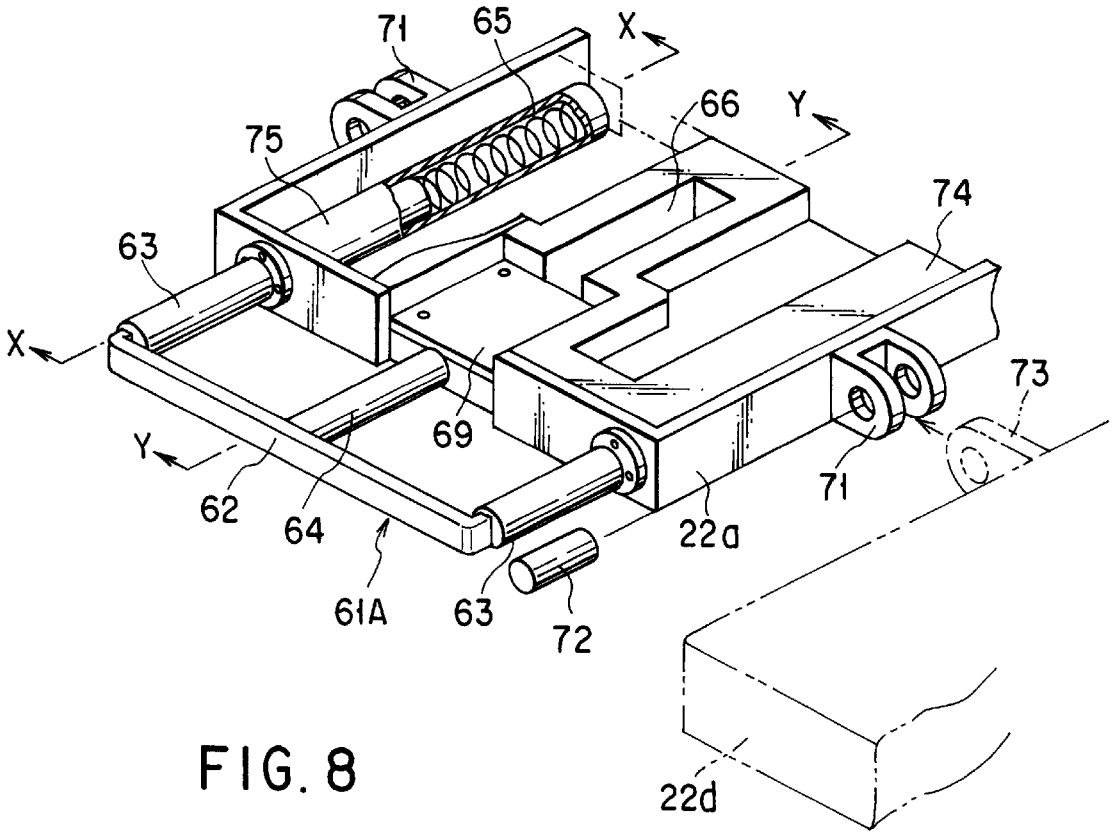
FIG. 8 is a perspective view showing a part where a support member is provided.
Figure 9A:
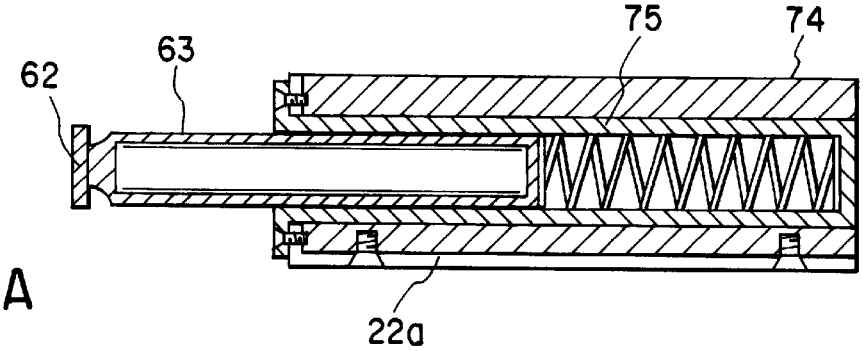
FIG. 9A is a sectional view as seen along a line X—X of FIG. 8.
Figure 9B:
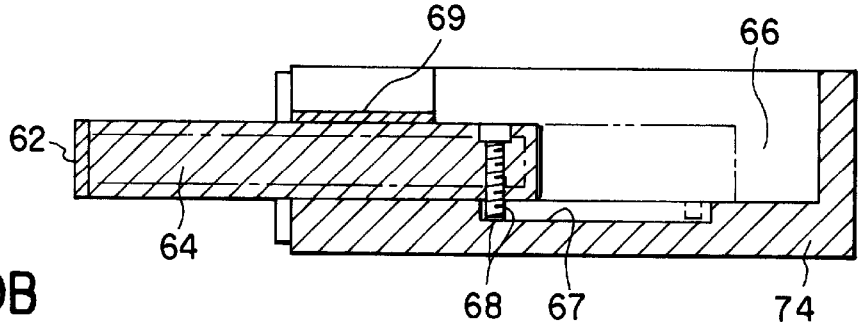
FIG. 9B is a sectional view as seen along a line Y—Y of FIG. 8.

FIGS. 7 to 9 show the second embodiment of the present invention. In this embodiment, as shown in FIGS. 7 and 8, bracket-shaped first connection members 71 are provided on one of adjacent side surfaces of five floor portions 22*a* to 22*e* of the floor plate 21, and tongue pieces 73 rotatably connected to the connection members 71 by connection shafts 72 are provided on the other side surfaces thereof, so that five floor portions are connected to be mutually rotatable.

The fixed floor portion 22*a,* which is fixed on the bed frame 5, opens to the lower side as shown in FIG. 8, and casing portions 74 (one of which is shown) are provided in both longitudinal end parts thereof. A support member 61A is supported on the casing portions 74. That is, in the support member 61A, similarly to the above first embodiment, the guide rods 63 are connected to both ends of the connection plate 62 and the stopper rod 64 is connected to the central part thereof.

A pair of guide cylinders 75 (one of which is shown) are provided in the casing portion 74 while their one-end surfaces open to the end surface of the fixed floor portion 22*a*. Further, the slide groove 66 is formed at a part between a pair of guide cylinders 75 of the fixed floor portion 22*a* so as to open to the end surfaces and the lower surface of the casing 74.

A pair of guide rods 63 of the support member 61A are inserted into the guide cylinders 75 to be freely slidable, and the stopper rod 64 is inserted into the slide groove 66 to be freely slidable.

The springs 65 elastically urging the support member 61A in the protruding direction are contained in the guide cylinders 75. The step portion 67 is formed on the slide groove 66. The stopper 68 provided at the distal end of the stopper rod 64 is engaged with the step portion 67 to restrict the position of the support member 61A sliding in the protruding direction.

An end part of the slide groove 66 is blocked by the pressing plate 69. For this reason, the stopper rod 64 is prevented from being detached from the slide groove 66.

On the floor plate 21, second recess portions 24A are formed at both longitudinal edges of the fixed floor portion 22*a*, by making the longitudinal dimension of the fixed floor portion 22*a* shorter than that of the other floor portions, as shown in FIG. 7.

Even in this structure, the worker deforms by compression the auxiliary member 55 of the mattress apparatus 51 while pushing the support member 61A against the urging force of the springs 65. The worker can therefore enter the second recess portions 24A of the floor plate 21.

(Third Embodiment)

Figure 10:
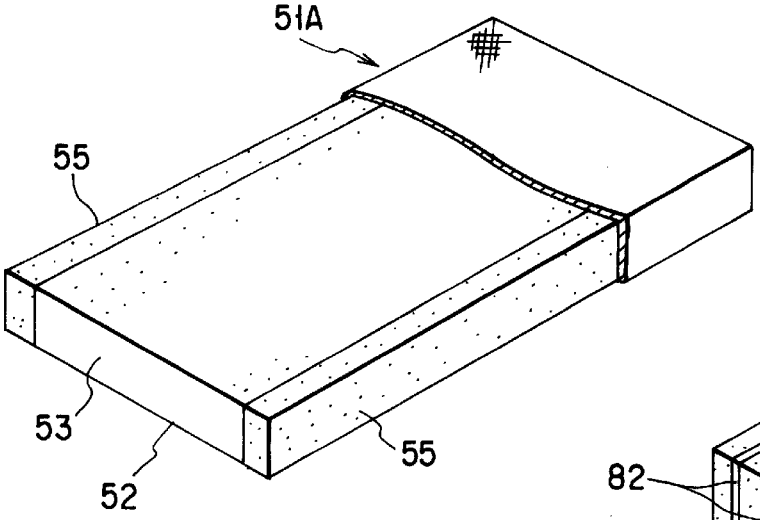
FIG. 10 is a perspective view showing a mattress apparatus from which a part of the packaging body is removed, according to a third embodiment of the present invention.

FIG. 10 shows a modified example of a mattress apparatus 51A according to a third embodiment of the present invention. In the mattress apparatus 51A of the present embodiment, the cushion body 52 is formed by providing the auxiliary members 55 on both lateral sides of the main body portion 53 along the entire longitudinal length thereof.

The mattress apparatus 51A of this structure can be used on the floor plate 21 of the bed apparatus of the first embodiment. In addition, if the width of the mattress apparatus 51A is made larger than that of the floor plate 21 and the auxiliary members 55 provided at both end portions thereof are designed to protrude in the width direction of the floor plate 22, the worker can approach the user, at any position in the longitudinal direction of the floor plate 22, by deforming by compression the auxiliary member 55 inwardly in the width direction of the floor plate 22.

The auxiliary member 55 may be provided on only one longitudinal side of the mattress apparatus 51A, as a modified example of the third embodiment.

Further, the longitudinal holes 57 which open vertically may be formed on the auxiliary members 55 as disclosed in the first embodiment.

(Fourth Embodiment)

Figure 11:
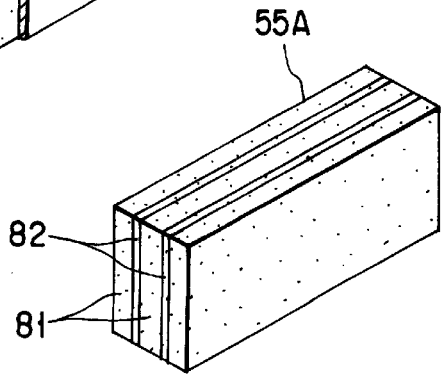
FIG. 11 is a perspective view showing an auxiliary member, according to a fourth embodiment of the present invention.

FIG. 11 shows a fourth embodiment illustrating a modified example of the auxiliary member 55A used in the first embodiment. The auxiliary member 55A is formed by intervening a hard sheet 82 between soft sheets 81 and by bonding and fixing them integrally.

According to this structure, the auxiliary member 55A can easily be deformed by compression in the thickness direction in accordance with the softness of the soft sheet 81 while it is hardly deformed in the vertical direction in accordance with the hardness of the hard sheet 82. Therefore, the supporting performance at a general use can be improved.

The structure of the auxiliary member 55A of the present embodiment may be applied to the auxiliary member 55 of the third embodiment shown in FIG. 10.

(Fifth Embodiment)

Figure 12:
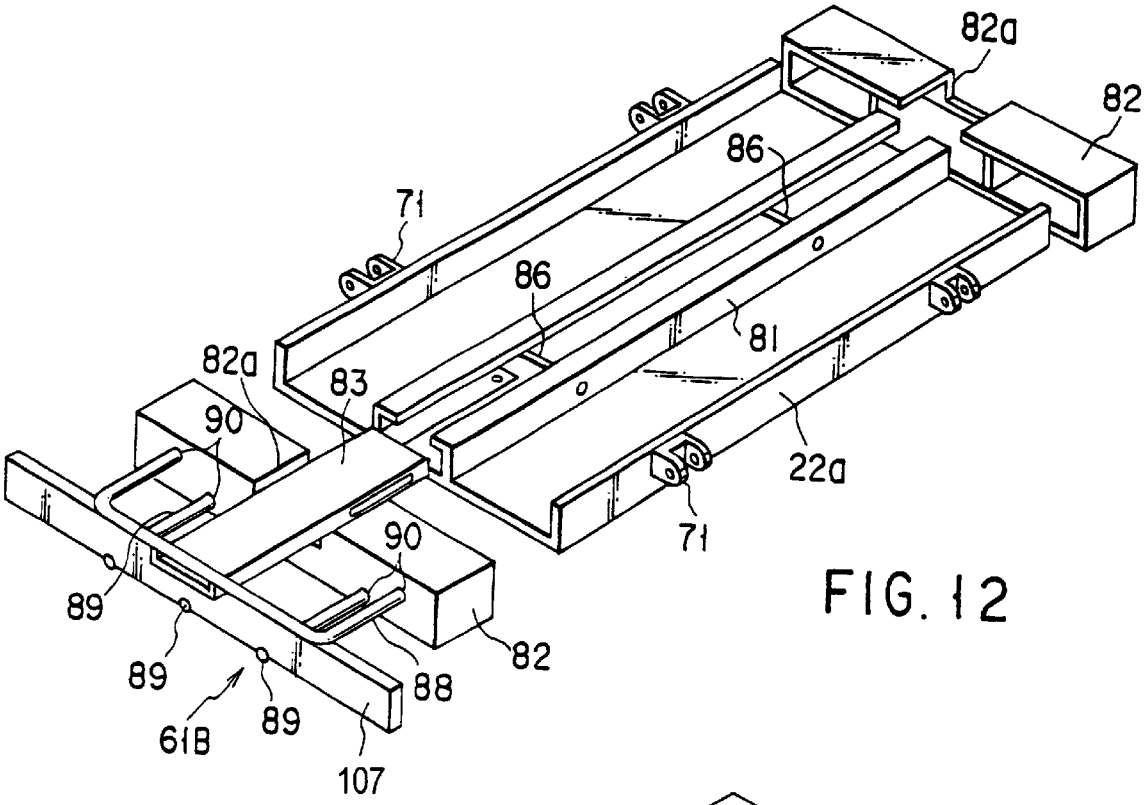
FIG. 12 is a perspective view showing a back surface side of a fixed floor portion, according to a fifth embodiment of the present invention.
Figure 13:
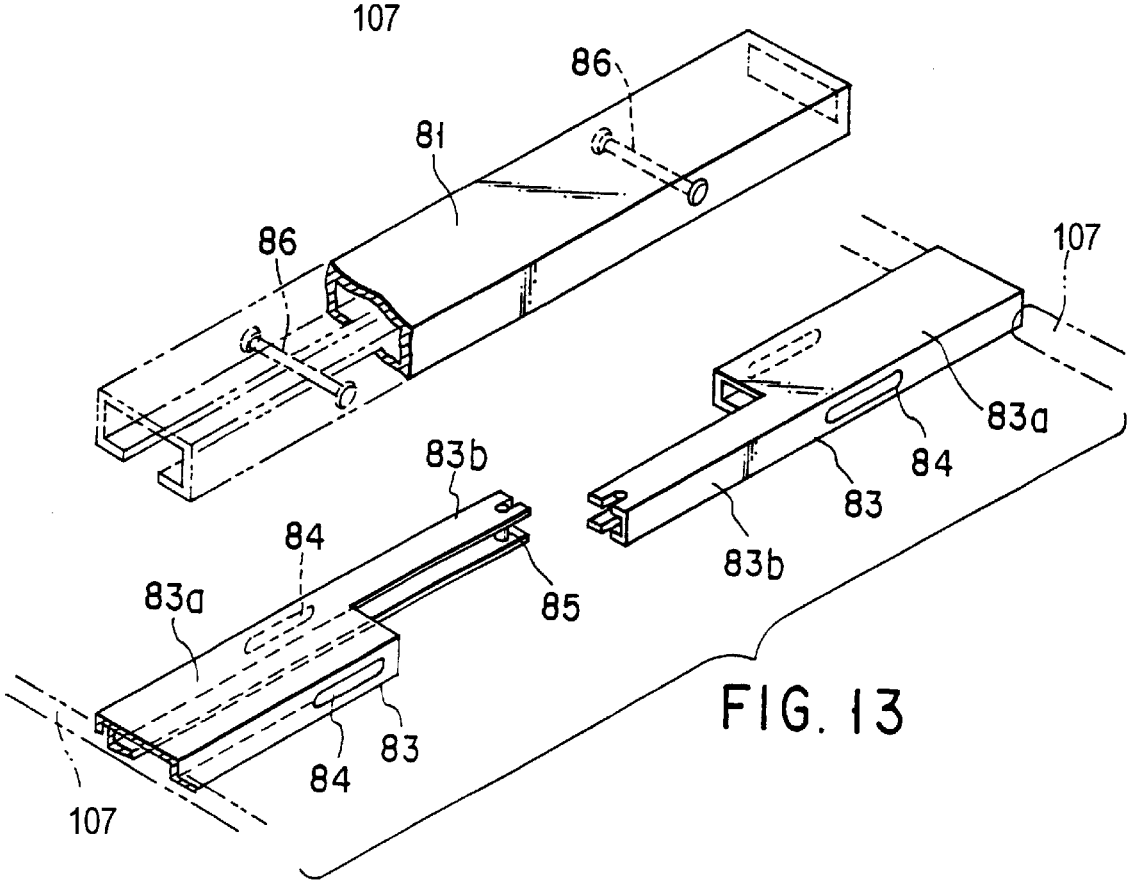
FIG. 13 is an exploded perspective view showing a guide body and sliders thereof.

FIGS. 12 to 14 illustrate a fifth embodiment of the present invention.

In the present embodiment, as shown in FIG. 12, a guide body 81 of a channel member extending to the entire lateral length of the fixed floor portion 22*a* is provided on the lower surface side of the fixed floor portion 22*a* of the floor plate 21, similarly to the second embodiment. Holding members 82 are attached to both lateral ends of the fixed floor portion 22*a*.

Figure 14A:
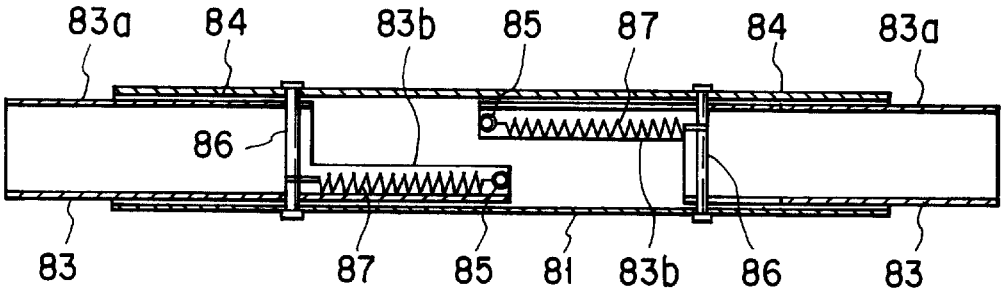
FIG. 14A is a plan view showing an assembled state of the guide body and the sliders.
Figure 14B:
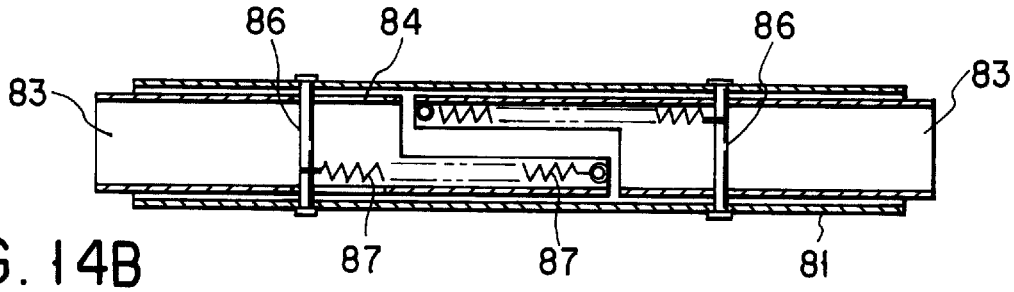
FIG. 14B is a plan view showing a state in which the sliders slide into the guide body.

A pair of sliders 83 are provided at the guide body 81 so as to freely slide as shown in FIGS. 13, 14A and 14B. The slider 83 is constituted by an angular cylindrical portion 83*a* and a bracket-shaped portion 83*b* having a substantially half dimensions of the angular cylindrical portion 83*a*. Long holes 84 having a predetermined length along the longitudinal direction are formed on both side walls of the angular cylindrical portion 83*a*, and a support shaft 85 is vertically provided at the end part of the bracket-shaped portion 83*b*.

Guide shafts 86 are provided in the lateral direction on one end side and the other end side of the guide body 81, respectively. The guide shafts 86 are inserted respectively into the long holes 84 of the sliders 83 provided at the guide body 81. Therefore, the sliders 83 can slide in the range of the long holes 84.

Coil springs 87 are provided between the support shafts 85 and the guide shafts 86. Therefore, each of the sliders 83 is elastically held while an end part thereof protrudes from the guide body 81 by the coil spring 87 as shown in FIG. 14A.

An end part of the slider 83 passes through a groove portion 82*a* formed on the holding member 82 to protrude to the second recess portion 24 of the floor plate 21 as shown in FIG. 12, and a support member 61B is provided on the end surface.

The support member 61B has a connection plate 107 whose longitudinally middle portion inner surface is fixed to an end surface of the slider 83. A middle part of a bracket-shaped rod 88 formed by bending a rod in a shape of a bracket is fixed on a lower end surface of the connection plate 107, and one-end parts of three guide rods 89 are fixed on an upper end surface thereof.

Both end parts of the bracket-shaped rod 88 and other-end parts of the guide rods 89 are slidably inserted into through-holes 90 serving as support portions formed on the holding member 82.

According to this structure, the support member 61B is attached to the slider 83 which is slidably provided at the guide body 81. Therefore, the sliding displacement of the support member 61B is smoothly executed.

Further, the coil spring 87 for giving the restoring force of the protruding direction to the support member 61B when it is displaced in the direction of inside the second recess portion 24, is provided in the guide body 81. Therefore, the entire structure can be made compact.

In the fifth embodiment, when the fixed floor portion 22*a* is formed of synthetic resin, the guide body 81 may not be formed as a separate member, but formed integrally with the fixed floor portion 22*aa*.

(Sixth Embodiment)

Figure 15:
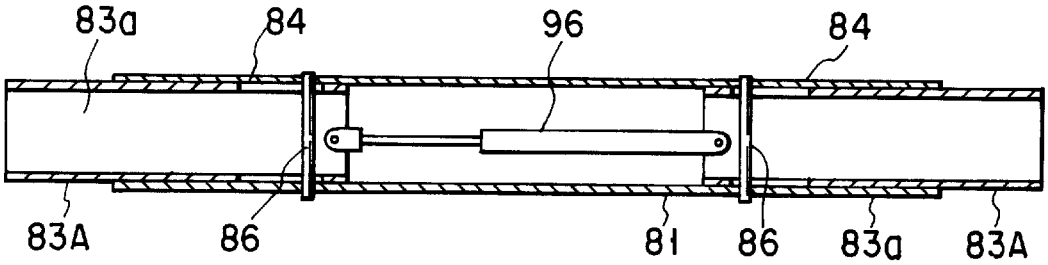
FIG. 15 is a plan view showing an assembled state of the guide body and the sliders, according to a sixth embodiment of the present invention.

FIG. 15 shows a sixth embodiment of the present invention, in which a gas spring 96 is employed instead of the coil spring 87 used in the fifth embodiment. That is, a pair of sliders 83A that are slidably supported in the guide body 81 are constituted only by the angular cylindrical portions 83*a*. An end and the other end of the gas spring 96 are connected to end parts of a pair of sliders 83A located in the guide body 81.

The gas spring 96 elastically supports a pair of sliders 83A. When the sliders 83A are displaced in the entering direction, the gas spring 96 is compressed to generate the restoring force.

The support member 61B shown in FIG. 12 is provided on the end part of the slider 83A protruding from the guide body 81.

The sliding range of the slider 83A is restricted by the long holes 84 and the guide shafts 86, similarly to the fifth embodiment.

(Seventh Embodiment)

Figure 16:
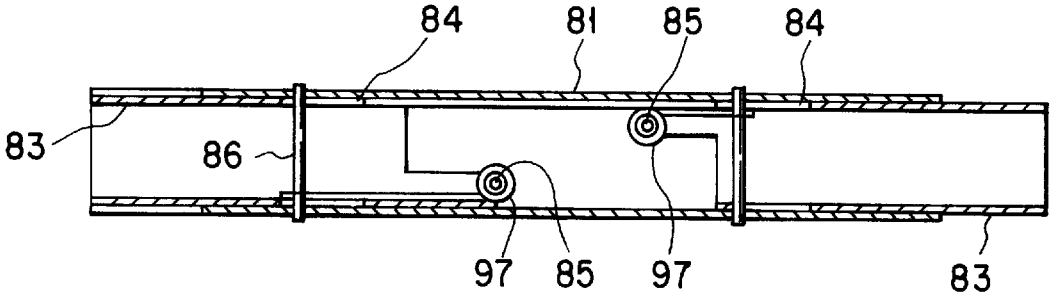
FIG. 16 is a plan view showing an assembled state of the guide body and the sliders, according to a seventh embodiment of the present invention.

FIG. 16 shows a seventh embodiment. The present embodiment is different with respect to the point of using mainsprings 97 instead of the coil springs 87 of the fifth embodiment, and the same in the other structural elements.

That is, the mainsprings 97 are held on the support shafts 85 provided at the top end parts of the bracket-shaped portions 83*b* of the sliders 83, and the top ends of the mainsprings 97 are connected to the guide shafts 86.

Therefore, the mainsprings 97 extend against the restoring force when the sliders 83 slide to be displaced in the entering direction. For this reason, when the force applied for the entrance is removed, the sliders are automatically restored in the protruding direction.

(Eighth Embodiment)

Figure 17:
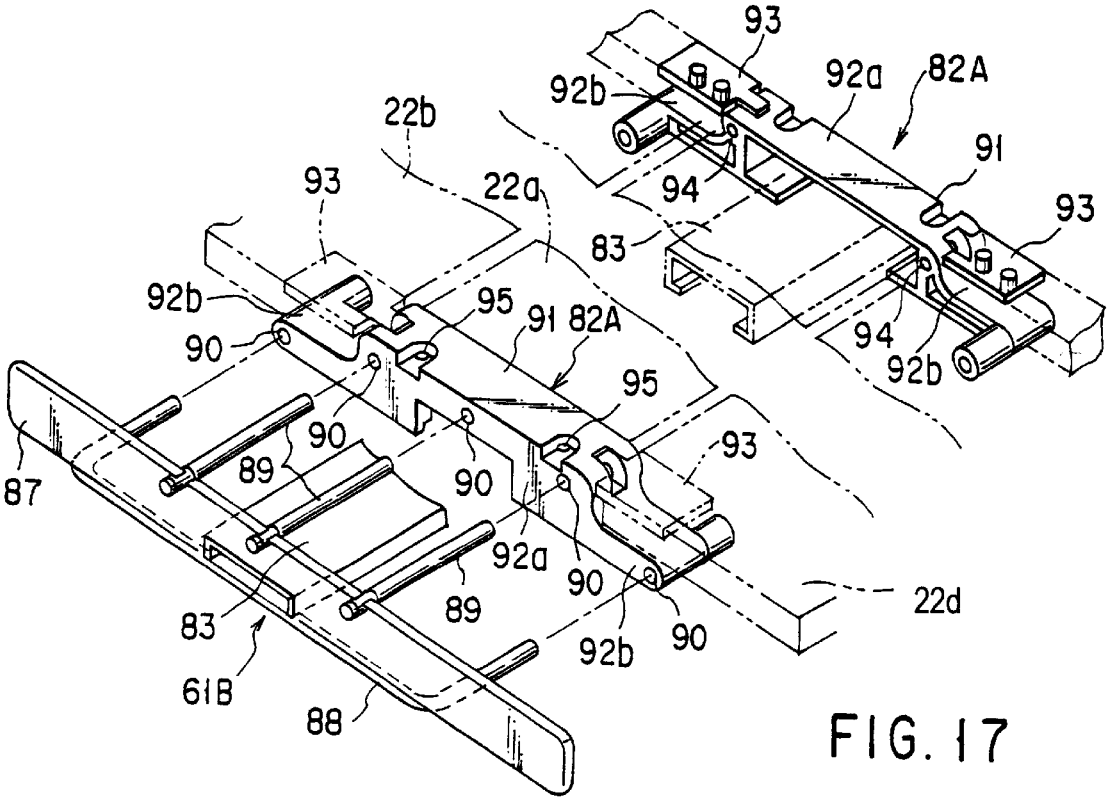
FIG. 17 is a perspective view showing a pair of holding members provided on both lateral sides of the fixed floor portion, according to an eighth embodiment of the present invention.

FIG. 17 shows an eighth embodiment of the present invention. The present embodiment is substantially the same as that shown in FIGS. 12 to 14, but is different with respect to the shape of holding members 82A provided on both lateral sides of the fixed floor portion 22*a*.

That is, each of the holding members 82A comprises an attachment portion 91 attached and fixed on the side surface of the fixed floor portion 22*a*. A thin portion 92*b* is formed on both sides of a thick portion 92*a* of the attachment portion 91, so that the one-end parts of the waist floor portion 22*b* and the first leg floor portion 22*d* that are adjacent to the fixed floor portion 22*a* are positioned on the thin portions 92*b*. This state is represented by chain lines in FIG. 17.

One-side ends of lever-like rotating portions 93 are connected to both end parts of the thick portion 92*a* by pins 94 so as to be freely rotatable. The rotating portions 93 are connected and fixed on the upper surfaces of the lateral end parts of the waist floor portion 22*b* and the first leg floor portion 22*d* positioned on the thin portions 92*b* by screws (not shown).

Attachment holes 95 are formed on both side parts of the thick portion 92*a* to open in the direction of the thickness, so that the holding members 82A are attached and fixed to the bed frame 8 by screws (not shown) inserted through the attachment holes 95.

According to the above structure, the holding members 82A for slidably supporting the support members 61B can also be used as connection members for rotatably connecting the waist floor portion 22*b* and the first leg floor portion 22*d* that are adjacent to the fixed floor portion 22*a*.

(Ninth Embodiment)

Figure 18:
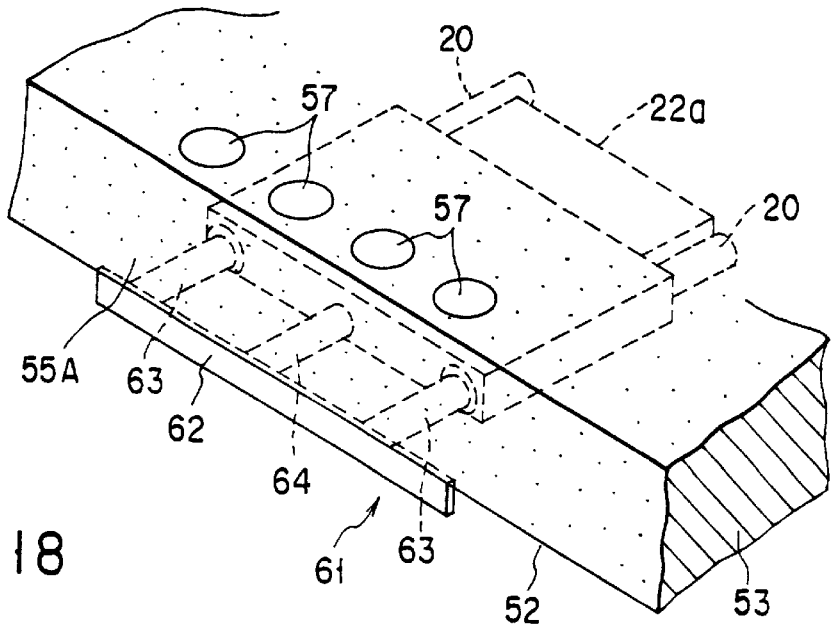
FIG. 18 is a perspective view showing a part of a main body of the mattress apparatus, according to a ninth embodiment of the present invention.

FIG. 18 shows a ninth embodiment of the present invention. The present embodiment is a modified example of the mattress apparatus 51. The mattress apparatus 51 is constituted by integrally forming the main body portion 53 of the cushion body 52 and the auxiliary member 55A with an elastic material such as foamed urethane foam and the like.

That is, a plurality of vertical holes 57 are formed to open at the portion corresponding to the support member 61 provided on the floor plate 21 of the bed apparatus. Thus, the auxiliary member 55A which can easily be deformed by compression more inwardly in the lateral direction than the other parts of the main body portion 53, is integrally formed on the main body portion 53.

The present invention is not limited to the above embodiments, but can be variously modified. For example, the main body portion of the mattress apparatus may be formed of a spring unit formed by springs instead of an elastic material such as urethane foam, sisal, and the like. Further, the auxiliary member provided in the first recess portion of the main body portion is not limited to be formed of a more elastic material than the material of the main body portion. Even an elastic material which is as hard as the main body or a hard material, can be used as the auxiliary member, if it is shaped to be easily deformable by compression in the lateral direction, for example, to be hollow.

Moreover, air mattress, water mattress, polyurethane foam, and particularly a material of low resistance may be used as the mattress apparatus. In other words, the mattress apparatus only needs to be constituted such that the support member can be displaced and also elastically deformed inwardly in the lateral direction.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A mattress apparatus comprising:

a cushion body having a main body portion; and at least one auxiliary member provided on a side part of at least one lateral side of the main body portion of the cushion body;

wherein vertical holes opening in a direction of thickness are formed in the auxiliary member, and the auxiliary member is adapted to be pressed inwardly in a lateral direction of the main body portion of the cushion body so as to be elastically deformed inward by compression.

2. A mattress apparatus according to claim 1, wherein a recess portion is formed on the side part of the at least one lateral side of the main body portion of the cushion body, said recess portion being dented inwardly in the lateral direction of the main body portion of the cushion body, and wherein the auxiliary member is provided in the recess portion.

3. The mattress apparatus according to claim 2, wherein the auxiliary member comprises a side surface extending along a longitudinal direction of the main body portion of the cushion body and an end surface extending along the lateral direction of the main body portion of the cushion body, and wherein only the side surface of the auxiliary member is bonded and fixed to the recess portion of the main body portion of the cushion body.

4. The mattress apparatus according to claim 1, wherein the main body portion of the cushion body comprises two lateral sides, and wherein two auxiliary members are provided each on a respective one of the two lateral sides of the main body portion of the cushion body, along substantially an entire length in a longitudinal direction of the main body portion of the cushion body.

5. The mattress apparatus according to claim 1, wherein the auxiliary member has a laminated structure obtained by bonding and fixing a soft sheet and a hard sheet.

6. The mattress apparatus according to claim 1, further comprising a bag-like packaging body covering the cushion body.

7. A bed apparatus comprising:

a bed frame;

a floor plate provided on the bed frame, said floor plate having two lateral side parts;

a recess portion formed on at least one of the two lateral side parts of the floor plate, said recess portion being dented inwardly in a lateral direction of the floor plate;

a support member arranged in the recess portion so as to be elastically movable inwardly in the lateral direction of the floor plate; and a mattress apparatus provided on the floor plate, said mattress apparatus comprising a part that corresponds to the recess portion and that is deformable by compression inwardly in the lateral direction of the floor plate;

wherein the floor plate is divided into a plurality of floor portions and adjacent ones of the floor portions are connected to be rotatable by a hollow connection shaft; and wherein the support member comprises a guide rod that is supported to be movable by the hollow connection shaft.

8. The bed apparatus according to claim 7, wherein the support member is elastically held by a spring for generating a restoring force at a time of inward movement in the lateral direction of the floor plate.

9. The bed apparatus according to claim 7, wherein the mattress apparatus comprises a cushion body having a main body portion, said cushion body being covered in a bag-like packaging body, and wherein the part of said mattress apparatus that corresponds to the recess portion formed in the floor plate and that is deformable by compression inwardly in the lateral direction of the floor plate is an auxiliary member which is provided on at least one side part of at least one lateral side of the main body portion of the cushion body.

10. The bed apparatus according to claim 9, wherein a recess portion is formed on the side part of the at least one lateral side of the main body portion of the cushion body, said recess portion being dented inwardly in the lateral direction of the main body portion of the cushion body, and wherein the auxiliary member is provided in said recess portion formed in the main body portion of the cushion body.

11. A bed apparatus comprising:

a bed frame;

a floor plate provided on the bed frame, said floor plate having two lateral side parts;

a recess portion formed on at least one of the two lateral side parts of the floor plate, said recess portion being dented inwardly in a lateral direction of the floor plate;

a support member arranged in the recess portion so as to be elastically movable inwardly in the lateral direction of the floor plate; and a mattress apparatus provided on the floor plate, said mattress apparatus comprising a part that corresponds to the recess portion and that is deformable by compression inwardly in the lateral direction of the floor plate;

wherein the floor plate is divided into a plurality of floor portions in at least one of which the recess portion is formed, and wherein a holding member is provided on a lateral end part of the floor portion in which the recess portion is formed, said holding member comprising an attachment portion attached to the lateral end part of the floor portion in which the recess portion is formed and a rotating portion having one end rotatably connected to the attachment portion;

wherein the support member comprises a guide body;

wherein a support portion for supporting the guide body to be slidable is provided on the attachment portion of the holding member; and wherein respective ones of the floor portions adjacent to the floor portion in which the recess is formed and to which the attachment portion is attached are connected to the rotating portion of the holding member.

12. The bed apparatus according to claim 11, wherein the support member is elastically held by a spring for generating a restoring force at a time of inward movement in the lateral direction of the floor plate.

13. The bed apparatus according to claim 11, wherein the guide body is provided along the lateral direction of the floor plate, on a lower surface side of the floor plate where the recess portion is formed, and wherein the support member is supported to be freely slidable on the guide body.

14. The bed apparatus according to claim 11, wherein the mattress apparatus comprises a cushion body having a main body portion, said cushion body being covered in a bag-like packaging body, and wherein the part of said mattress apparatus that corresponds to the recess portion formed in the floor plate and that is deformable by compression inwardly in the lateral direction of the floor plate is an auxiliary member which is provided on at least one side part of at least one lateral side of the main body portion of the cushion body.

15. The bed apparatus according to claim 14, wherein a recess portion is formed on the side part of the at least one lateral side of the main body portion of the cushion body, said recess portion being dented inwardly in the lateral direction of the main body portion of the cushion body, and wherein the auxiliary member is provided in said recess portion formed in the main body portion of the cushion body.

* * * * *